US007641287B2

(12) United States Patent
Boucherie

(10) Patent No.: US 7,641,287 B2
(45) Date of Patent: Jan. 5, 2010

(54) METHOD FOR MANUFACTURING BRUSHES

(75) Inventor: Bart Gerard Boucherie, Izegem (BE)

(73) Assignee: Firma G.B. Boucherie, naamloze vennootschap, Izegem (BE)

( * ) Notice: Subject to any disclaimer, the term of this patent is extended or adjusted under 35 U.S.C. 154(b) by 299 days.

(21) Appl. No.: 10/776,166

(22) Filed: Feb. 12, 2004

(65) Prior Publication Data

US 2004/0164604 A1 Aug. 26, 2004

(30) Foreign Application Priority Data

Feb. 21, 2003 (BE) ..... 2003/0118

(51) Int. Cl.
*A46D 1/06* (2006.01)

(52) U.S. Cl. ..... 300/21; 300/17; 300/5

(58) Field of Classification Search ..... 300/5, 300/17, 21, 10, 7, 8
See application file for complete search history.

(56) References Cited

U.S. PATENT DOCUMENTS 5,176,427 A * 1/1993 Weihrauch ..... 300/10
5,431,484 A * 7/1995 Zahoransky et al. ..... 300/2
5,728,408 A * 3/1998 Boucherie ..... 425/116
6,290,303 B1 * 9/2001 Boucherie ..... 300/5
6,372,163 B1 * 4/2002 Boucherie ..... 264/68
6,406,099 B2 * 6/2002 Boucherie ..... 300/21
6,702,394 B2 * 3/2004 Boucherie ..... 300/21
6,779,851 B2 * 8/2004 Bouchiere ..... 300/21
6,837,548 B2 * 1/2005 Boucherie ..... 300/17

FOREIGN PATENT DOCUMENTS

| | | |
|---|---|---|
| DE | 44 41 985 A1 | 5/1996 |
| EP | 0 346 646 A2 | 12/1989 |
| EP | 0 674 862 A1 | 10/1995 |
| EP | 0 972 465 | 4/2003 |
| EP | 0 972 646 | 2/2004 |

* cited by examiner

*Primary Examiner*—Shay L Karls
(74) *Attorney, Agent, or Firm*—Bacon & Thomas, PLLC

(57) ABSTRACT

Method for manufacturing brushes, whereby bundles of fibers (12) are provided in a brush body (13), whereby this method also comprises a step whereby the far ends (2) of the fibers (3) are subjected to a processing by bringing them into contact with a processing equipment (5), characterized in that, during the aforesaid step, the fibers (3) and the processing equipment (5) are mutually put into contact whereas the fibers (3) are being held loosely together.

18 Claims, 8 Drawing Sheets

METHOD FOR MANUFACTURING BRUSHES

BACKGROUND OF THE INVENTION

Method and Device for Manufacturing Brushes.

1) Field of the Invention

The present invention concerns a method and device for manufacturing brushes, whereby bundles of fibers are provided in a brush body.

2) Discussion of the Related Art

It is known that the fibers of brushes can be finished at their free ends.

A traditional finishing consists in rounding off the far ends of the fibers, among others to prevent them from having sharp edges. This is particularly important when manufacturing tooth brushes, in order to prevent that, when using the obtained tooth brushes, the gums would be hurt by the sharp edges.

It is known that the rounding off can take place after the bundles of fibers have already been placed in the brush bodies. However, this technique is disadvantageous in that the rounding-off process is not optimal when fiber bundles of different lengths are being used and when fiber bundles which have not been cut off straight are being used, since not all the fiber bundles will make contact with the grinding tool used for the rounding off in the same manner in this case.

In order to remedy this, it is also known to first form bundles of fibers which have to be provided in a specific brush body, and to first process the far ends of these fibers, before placing them in the brush body. The fiber bundles can then, as they are provided in a holder, be mutually positioned such that they can all be optimally presented to a processing tool. The same applies to the fibers of one and the same bundle.

In the case of the latter technique, the fiber bundles are clamped in the holder while being finished by means of special clamping means, for example as described in EP 0,346,646. However, this technique is disadvantageous in that the holders have to be made rather complex, since also clamping means and drive means have to be provided to these holders, which are usually relatively small.

Further, it is also known to first lead fibers through a special device in order to round them off, after which they can be further processed in any way whatsoever. An example thereof is known from EP 0.674.862, whereby bundles of fibers are separated from a fiber stock by means of a holder in the shape of a rotating bundle remover and temporarily stay in this holder to be subsequently, after a certain rotation of the bundle remover, supplied again to a cartridge. During the rotation, the fibers pass along a device for rounding off the fiber ends. In EP 0.674.862, this device is schematically represented and no explanation is given as to whether the fibers are either or not clamped in particular. In reality, the fibers are indeed clamped in particular with a relatively large clamping force, by means of special clamping means. In practice, such a device is relatively complex as extra clamping means are required.

SUMMARY OF THE INVENTION

In the field concerned, it was always thought that, when such processing equipment would be brought into contact with fibers which are not soundly clamped, these fibers would be drawn out of the holder at the first contact with the processing equipment, as the first contact is rather rough, so that the fibers tend to catch on the processing equipment.

Against all expectations, the inventor found that the above-mentioned disadvantage not always manifests itself, and that it is possible indeed to subject fibers to a finishing while these fibers are being held loosely together, which has for a major advantage that the manufacturing process of brushes can be considerably simplified.

Taking into account this unexpected effect, the present invention first of all concerns a method for manufacturing brushes, whereby bundles of fibers are provided in a brush body, whereby this method also comprises a step whereby the far ends of the fibers are subjected to a processing by bringing them into contact with a processing equipment, characterized in that, during the aforesaid step, the fibers and the processing equipment are mutually put into contact whereas the fibers are being held loosely together.

As the fibers can now also be held loosely together, different advantages are obtained. Thus, it is for example no longer necessary to make use of the above-mentioned clamping means. As the fibers are being held loosely together, they can simply rest on an underlying support, so that all fibers will always be in line at the bottom, or will tend to always put themselves in line due to the vibrations occurring during the finishing operation.

The fibers are preferably kept together in a holder, in particular they are simply placed in an opening in such a holder, as a result of which the use of complicated constructive parts is excluded.

Although it is indeed possible to process the far ends of the fibers while they are being loosely held together, the fibers can indeed be drawn out of the holder by the processing equipment, which effect partly depends on the fiber qualities of course.

In order to preclude such a disadvantageous effect with great certainty, the inventor further invented a special technique which consists in initially giving less freedom of movement to the fiber ends to be processed and in subsequently enlarging this freedom of movement. By initially admitting only a limited freedom of movement for the fiber ends, these far ends will not so easily bend and/or they will not be so easily drawn out of the holder concerned, as a result of which they remain in the holder with great certainty. Thus, in a first phase, it is already possible to apply a processing without thereby pulling fibers out of the holder. During this processing, the largest roughnesses can for example already be removed. By subsequently giving more freedom of movement to the fiber ends, the free fiber length can be optimized as a function of the finishing to be applied, for example in order to obtain an optimal rounding. As the largest roughnesses have already been removed in the first phase, the fibers will no longer tend to catch on the processing equipment, so that they will remain with great certainty in the holder in the second phase as well.

The aforesaid can for example be realized by bringing the fibers with their far ends to be processed in contact with the processing equipment while extending out of the holder over a certain free length, and by enlarging this free length while the above-mentioned processing takes place.

While the aforesaid free length is being enlarged, the distance between the processing equipment and the side of the holder, from which the fibers protrude, will preferably be enlarged, whereas the contact between the free ends of the fibers and the processing equipment is being maintained. The freedom of movement or movableness of the far ends to be processed is enlarged then, not only because the free length is enlarged, but also because the space in which they can move is enlarged.

Preferably, the fibers are initially presented with a free length out of the holder and in contact with the processing equipment, which is on average smaller than 1 millimeter, in order to prevent that the far ends of the fibers would get too much freedom of movement.

According to another possibility, not the free length of the far ends protruding out of the holder is taken as a criterion, but the free distance between the side of the holder from which the aforesaid far ends protrude and the processing equipment. The method of the invention is then preferably characterized in that the processing at least consists of two steps, namely a step in which the processing equipment makes contact with the far ends of the fibers, whereas the processing equipment is situated at a certain distance from the side of the holder from which the fibers protrude, and a subsequent step in which said distance is larger and/or is symmetrically enlarged. The aforesaid distance in the first-mentioned step will in this case be preferably smaller than 1 millimeter.

According to a practical embodiment, the processing equipment will first be positioned up to a certain distance from the side of the holder out of which the fibers protrude, and the fibers are subsequently brought into contact with the processing equipment with their far ends.

It is clear that the invention is in the first place meant to round off the far ends of fibers, preferably by means of a grinding tool, polishing disc or the like, which can be presented as such to the fibers in different manners and according to different movements.

The invention is particularly useful for manufacturing tooth brushes, because it is very important for tooth brushes that the fibers are rounded off on the one hand, and because the fibers of tooth brushes are very light on the other hand and tend to get easily drawn out of the holder by the processing equipment while being rounded off.

The invention is also particularly useful in applications whereby it is used in combination with the use of at least one holder equipped with at least one opening in which the fibers are provided by pushing them in said opening in the longitudinal direction. For, in such applications, the fibers are usually rather loose, which was always regarded as a disadvantage until now for rounding off the fiber ends, and which no longer has to cause any problems according to the present invention.

The present invention is particularly useful when it is used in a manufacturing process whereby bundles of fibers are placed in a holder as a function of a fiber bundle pattern of a brush or of a brush part to be manufactured, after which the thus obtained package of bundles is fixed in a brush body. As use is hereby already being made of holders, these holders can also be used to present the fibers to a processing equipment without these holders having to be equipped with special clamping means.

It is also particularly useful in applications whereby fibers are temporarily separated from a fiber stock by means of a holder in the shape of a bundle remover, whereby the method of the invention is then applied while the bundles of fibers are situated in said holder.

Secondly, the invention also concerns a device for manufacturing brushes according to the above-described method, characterized in that it comprises a device for processing the far ends of fibers and in that the latter device at least consists of a holder in which fibers can be held loosely together, as well as a processing equipment which can work in conjunction with the free ends of the above-mentioned loose fibers while they are provided in the above-mentioned holder.

According to a preferred embodiment, this device also comprises means, in particular push-out elements, to bring the fibers further out of the holder with their free ends; drive means for moving one or several of the above-mentioned elements, in other words the holder and/or the processing equipment and/or the push-out elements; and a control with which said movement takes place in such a manner that a method is created whereby, as described above, the free ends of the fibers first have little freedom of movement, whereas in a following phase, more freedom of movement is possible.

BRIEF DESCRIPTION OF THE DRAWINGS

In order to better explain the characteristics of the invention, the following preferred embodiments are described as an example only without being limitative in any way, with reference to the accompanying drawings, in which.

DESCRIPTION OF THE PREFERRED EMBODIMENT

Figure 1:
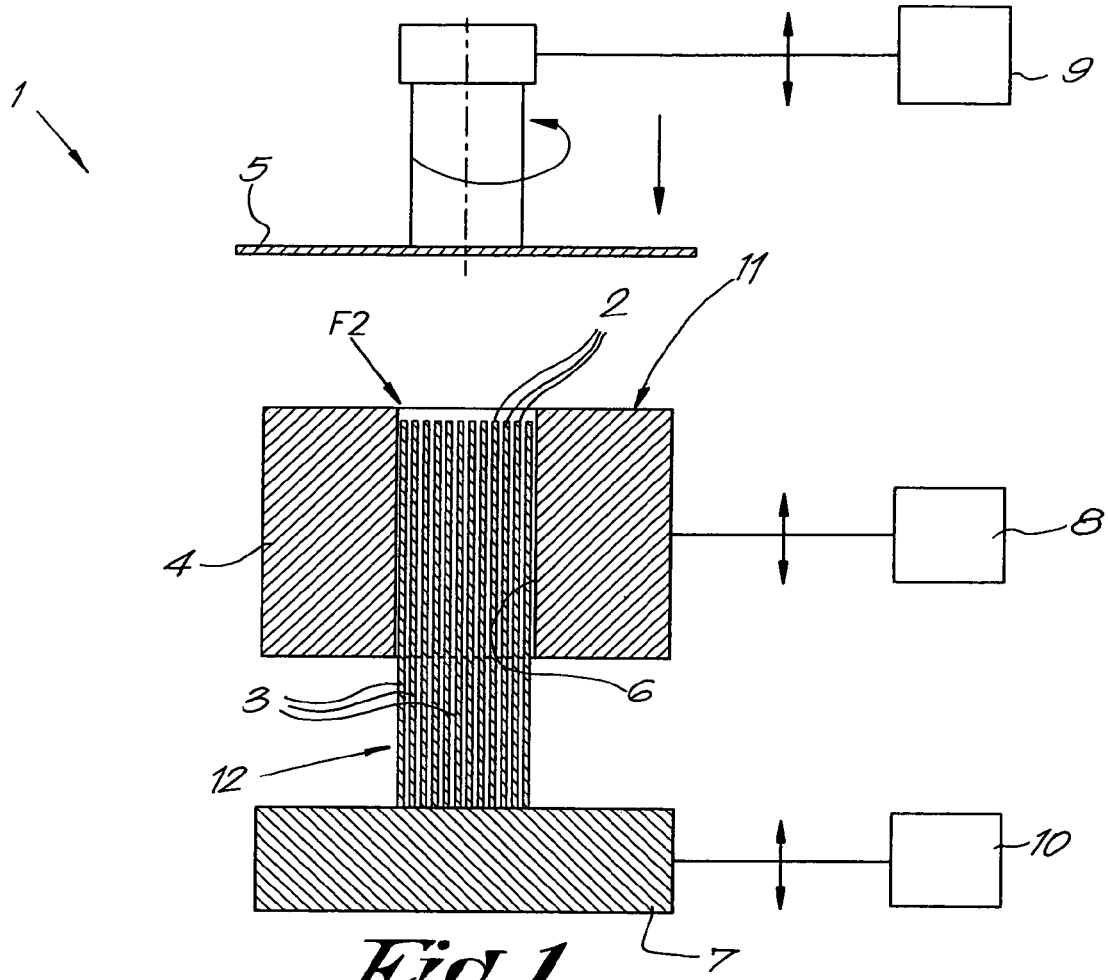
FIG. 1 schematically represents a device according to the invention.

FIG. 1 schematically represents a device 1 for processing the far ends 2 of fibers 3 for manufacturing brushes.

This device 1 mainly consists of a holder 4 in which the fibers 3 are loosely held together and a processing equipment 5, in this case a grinding tool for rounding off the far ends 2, which can be put into contact with the far ends 2.

The fibers 3 are hereby simply situated in an opening 6 provided in the holder 4, and they are for example supported by means of an element 7, either a support or a push-out element.

Some of the above-mentioned parts, namely the holder 4 and/or the processing equipment 5 and/or the element 7 can be moved in relation to each other, in particular in height in FIG. 1. This can be done in any manner whatsoever, whereby these parts can be either or not coupled to each other by means of certain transmissions. However, for clarity's sake, FIG. 1 only represents drive means in the shape of drive parts 8-9-10 with which the holder 4, the processing equipment 5 and the element 7 respectively can be moved in height, in particular according to a technique which corresponds to the method of the invention and as will be explained hereafter.

Figure 2:
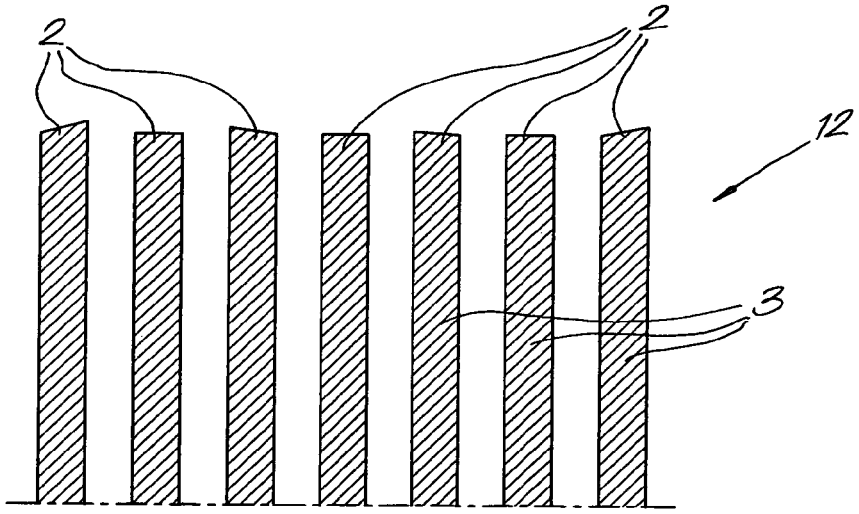
FIG. 2 represents a view according to arrow F2 in FIG. 1 to a larger scale.

Initially, the far ends of the fibers 3 are cut off with rather straight edges, which however, as represented in FIG. 2, may differ somewhat from each other.

Figure 3:
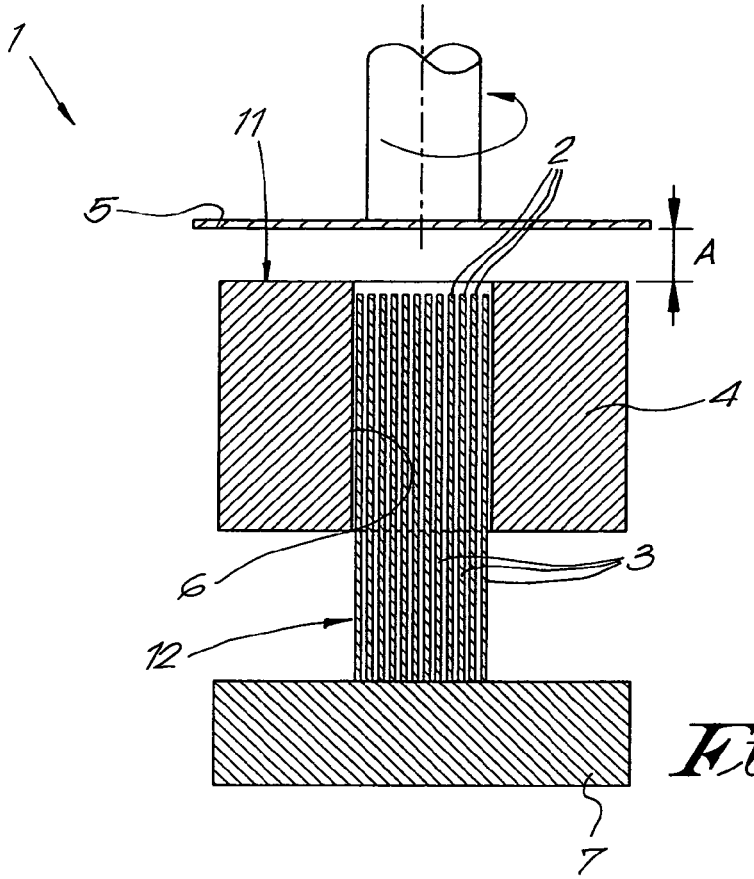
FIGS. 3 to 5 represent views analogous to that in FIG. 1, for different positions.
Figure 4:
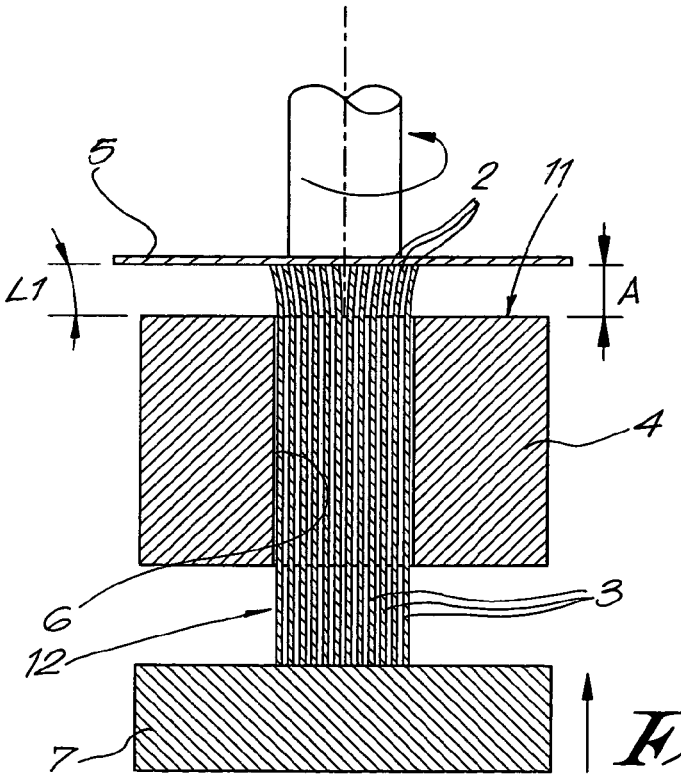

According to the invention, the far ends 2 are first put into contact with the processing equipment 5 with little freedom of movement or with little movableness. In the embodiment of FIGS. 3 and 4, this is done by first presenting the processing equipment 5 at a certain distance A above the side 11 of the holder 4, from which the fibers 3 can be made to protrude with their free ends 2. This initial distance A is selected rather small and, in reality, it is preferably smaller than one millimeter.

Next, the fibers 3 are brought up against the processing equipment 5 with their far ends 2. As the free length L1 over which the fibers 3 protrude out of the holder 4 is hereby small, they can move but little, and the chance that the fibers 3 will be carried along by the meshing forces of the processing equipment 5 is very small. By moving the processing equipment 5 over the far ends 2, for example in a rotating and/or translating manner alongside of them, a first rounding-off effect is obtained.

As a result of this first rounding-off effect, the fibers 3 obtain as a quality that they will be less inclined to catch onto the processing equipment 5.

Figure 5:
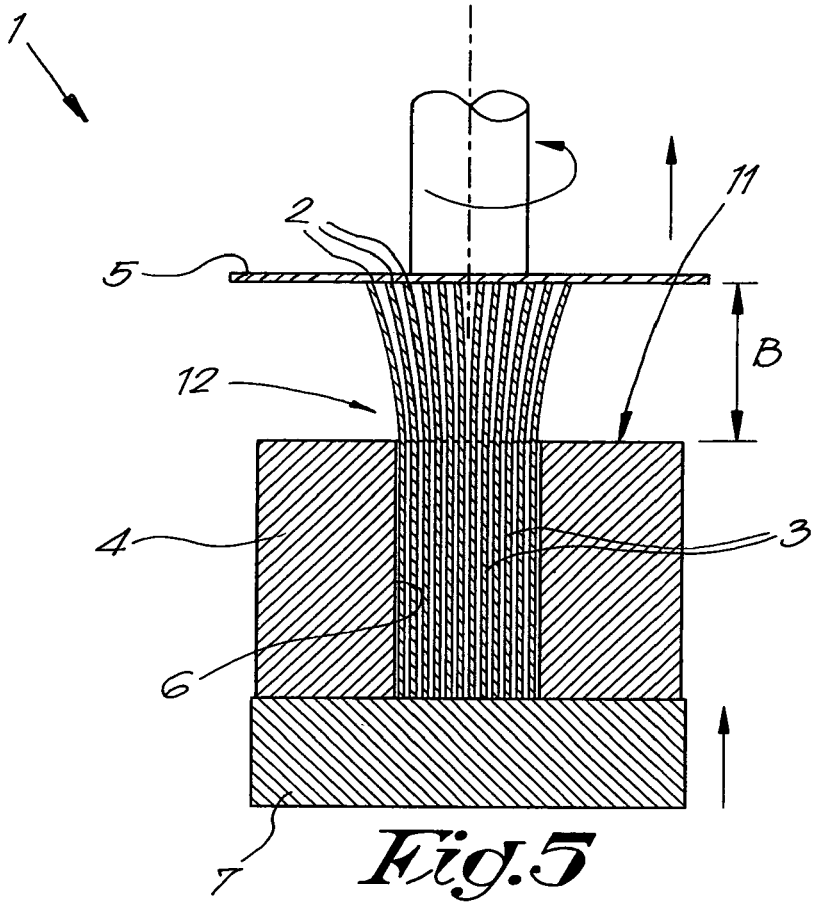

Next, the distance between the side 11 and the processing equipment 5 can be enlarged, for example up to a value B, as represented in FIG. 5. As a result, the far ends 2 obtain more freedom of movement, which allows for a normal rounding-off effect. As the tendency to mesh with the processing equipment 5 has been reduced, working with the larger distance B no longer forms a problem.

Figure 6:
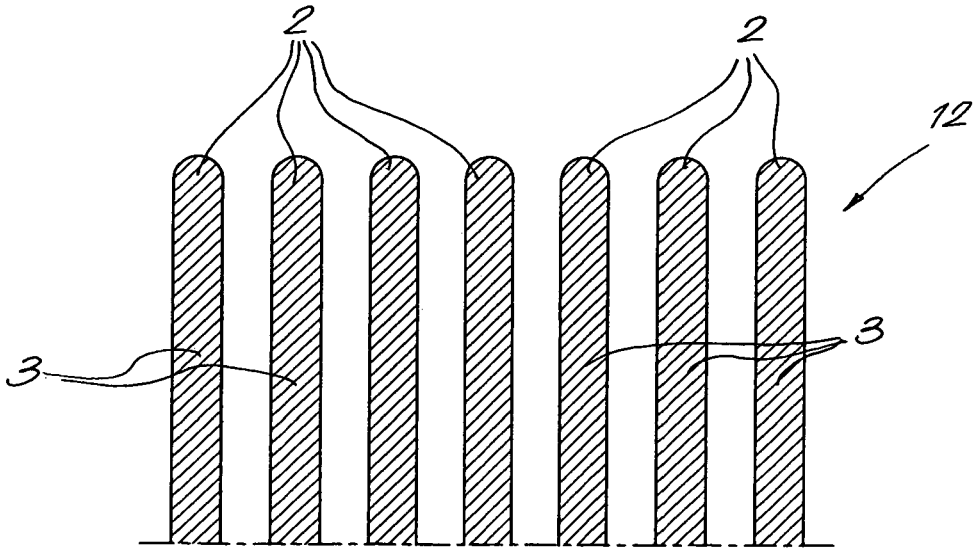
FIG. 6 represents a view analogous to that of FIG. 2, but after the fiber ends have been processed.

In the end, fibers 3 with rounded-off ends 2 are obtained, as represented in FIG. 6.

It is clear that the mutual movements of the parts, in particular the holder 4, the processing equipment 5 and the element 7 can be realized in different ways. At the transition of the situation in FIG. 4 to that in FIG. 5, either the holder 4 alone can be moved down, or both the element 7 and the processing equipment 5 can be moved up. In the latter case, the element 7 and the processing equipment 5 do not necessarily have to carry out the same movement.

Figure 7:
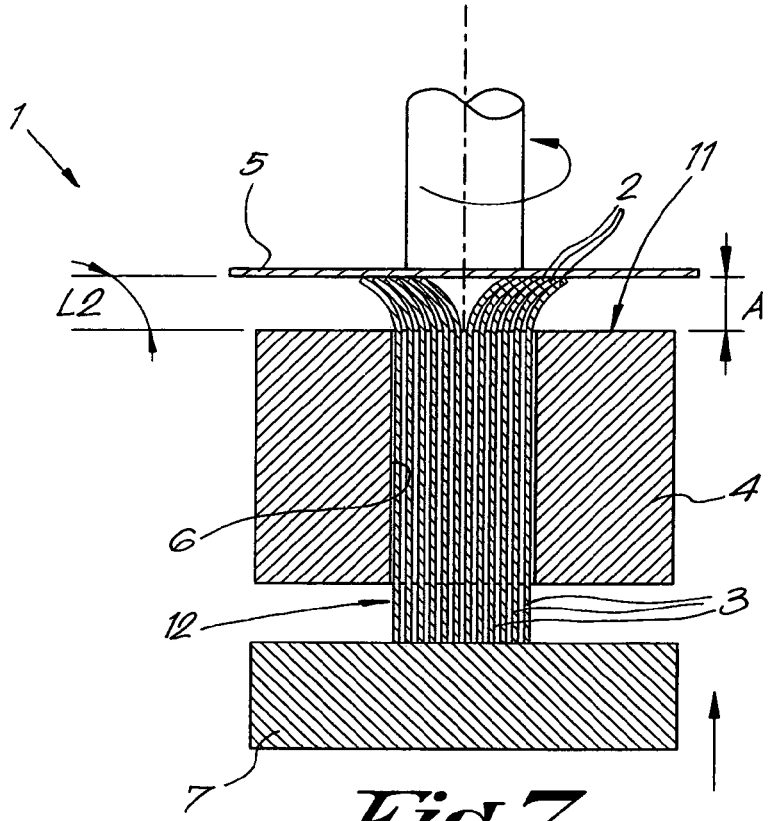
FIG. 7 schematically represents a variant.

Nor is it excluded to work with a fixed distance, for example the above-mentioned distance A, and to first provide a slight movableness to the free ends 2, by pushing them out of the holder 4 over a certain free length L1 as represented in FIG. 4, and by subsequently providing them more movableness by pushing them further out of the holder 4 with their free ends 2, as represented in FIG. 7. However, preference is given to the embodiment in which the distance between the holder 4 and the processing equipment 5 is changed.

Figure 8:
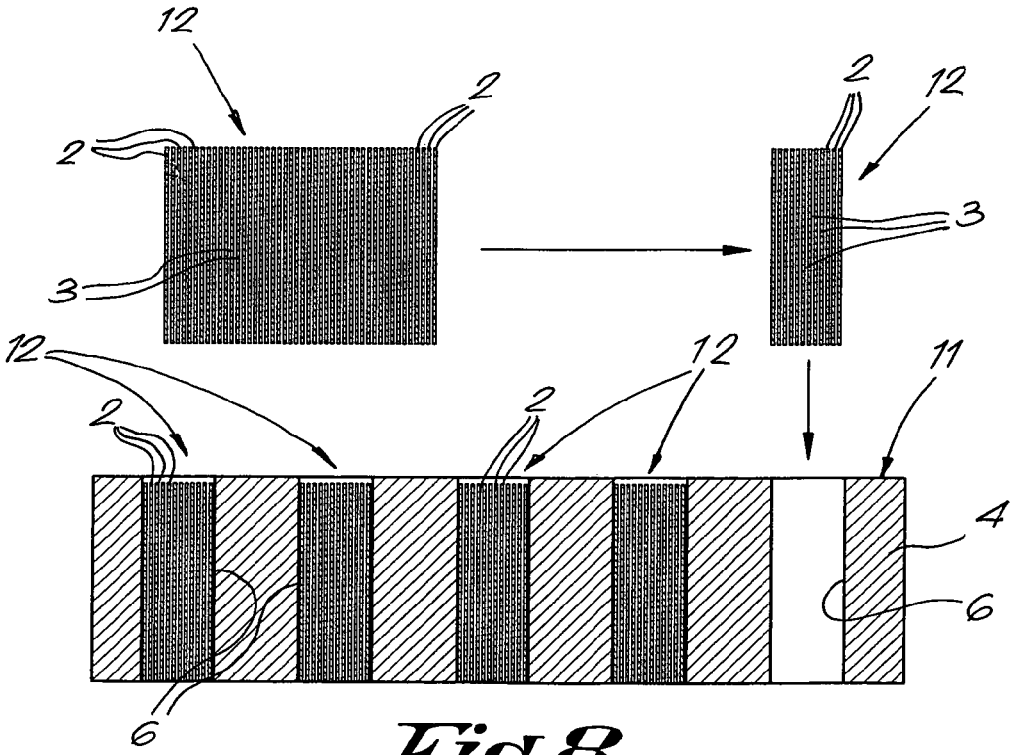
FIGS. 8 to 11 schematically represent another variant for different positions.

FIG. 8 represents a variant in which a holder 4 with several openings 6 is used, whereby the number and possibly the shape of these openings are selected as a function of a fiber bundle pattern of a brush or brush part to be manufactured.

The openings 6, as schematically represented in FIG. 8, are hereby first systematically filled with bundles 12 formed of fibers 3.

Figure 9:
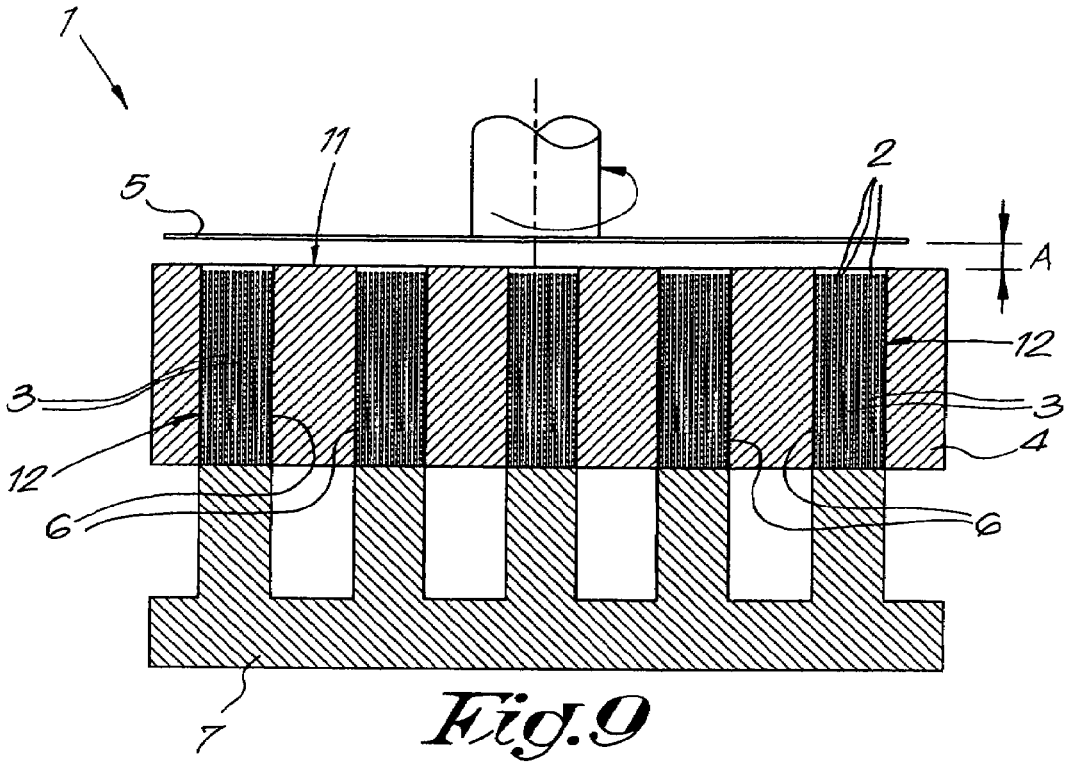
Figure 10:
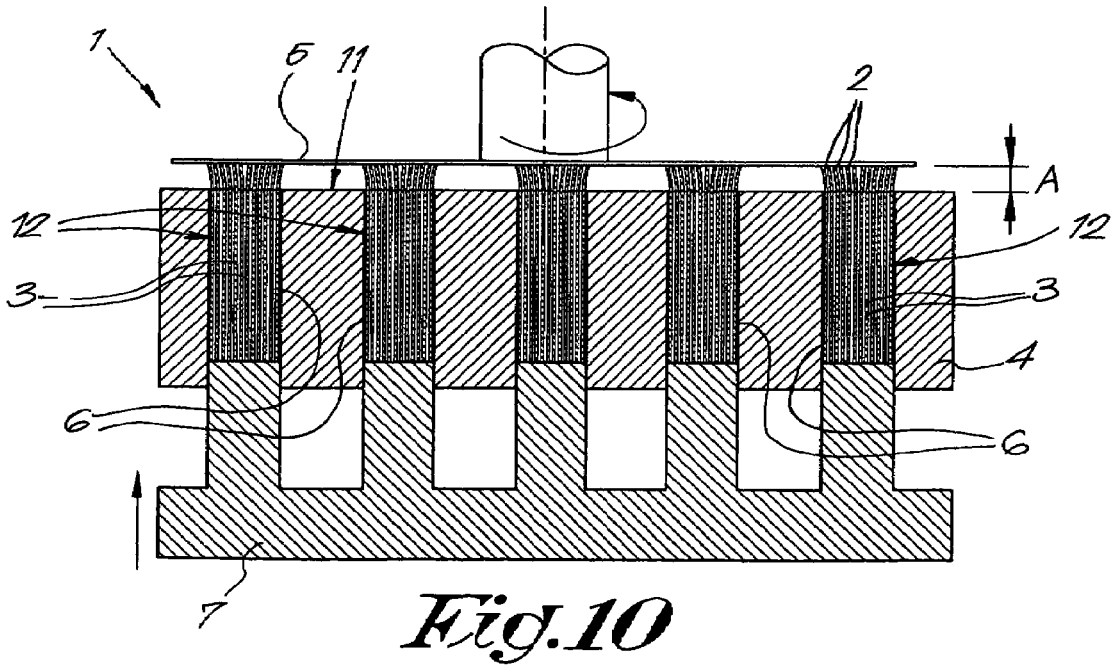
Figure 11:
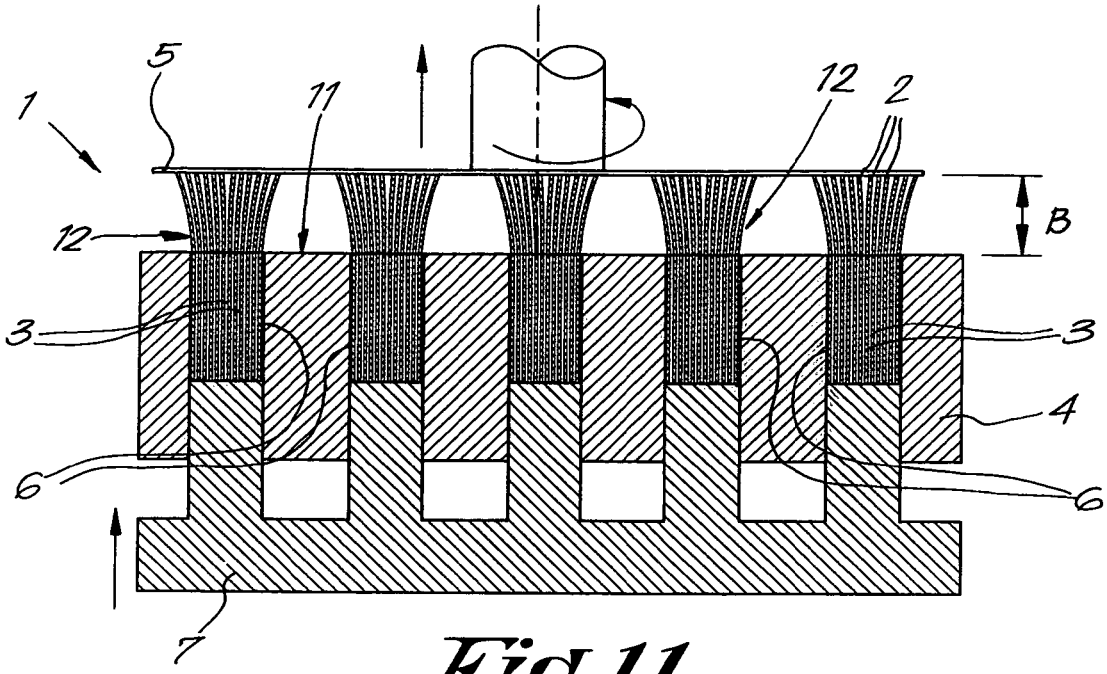

Moreover, one can process in the same manner as represented in FIGS. 3 to 5, what is represented for the embodiment of FIG. 8 in FIGS. 9 to 11.

Figure 12:
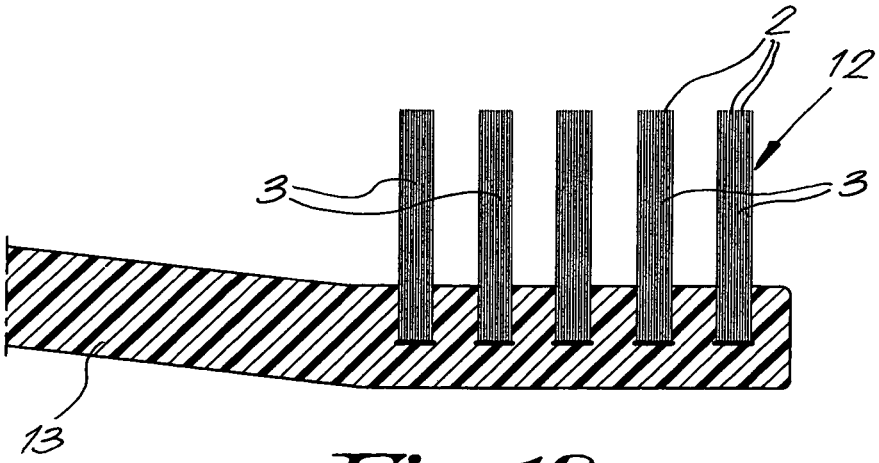
FIG. 12 represents a brush whose fiber bundles have been processed in the device from FIGS. 8 to 11.

The fibers 3 obtained from a single holder 4 can subsequently be provided in a known manner in a brush body 13, as represented in FIG. 12.

Several techniques are known as such for filling the holders 4 and for subsequently transferring the bundles 12 into the brush bodies 13, among others from EP 0.972.646, EP 0.972.465 and EP 0.346.646. Since the techniques for filling the holders 4 and subsequently transferring the bundles 12 into the brush bodies 13 are sufficiently known as such from the state of the art, and moreover do not form the core of the present invention, we will not go into it any further.

Figure 13:
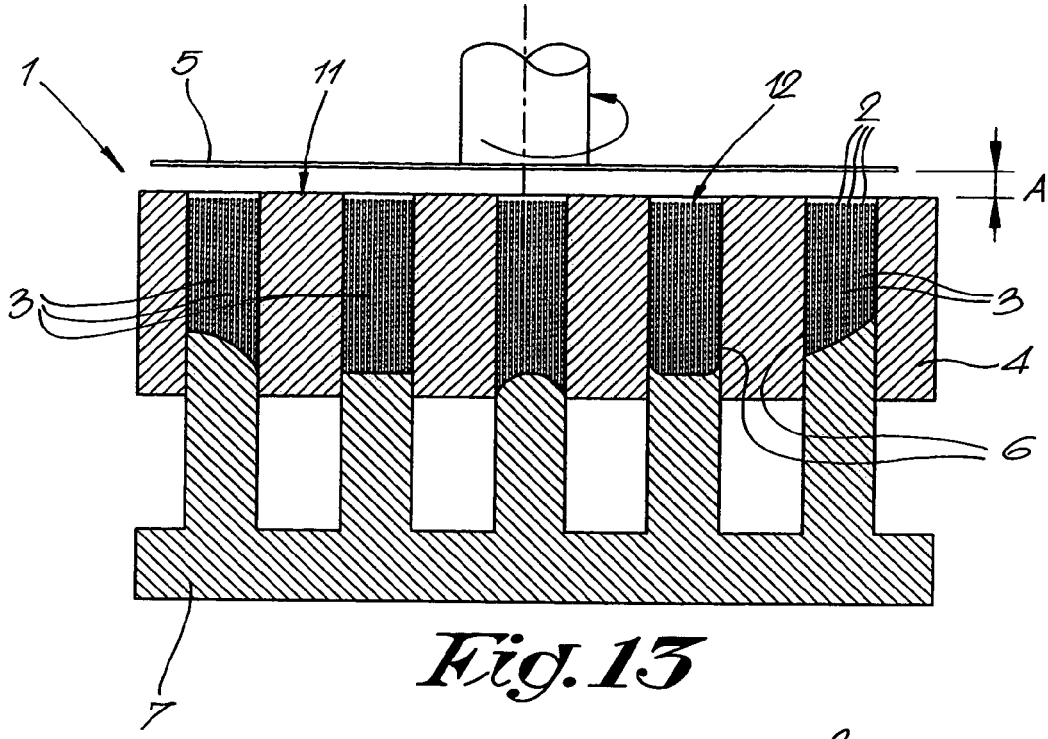
FIG. 13 represents another device according to the invention.
Figure 14:
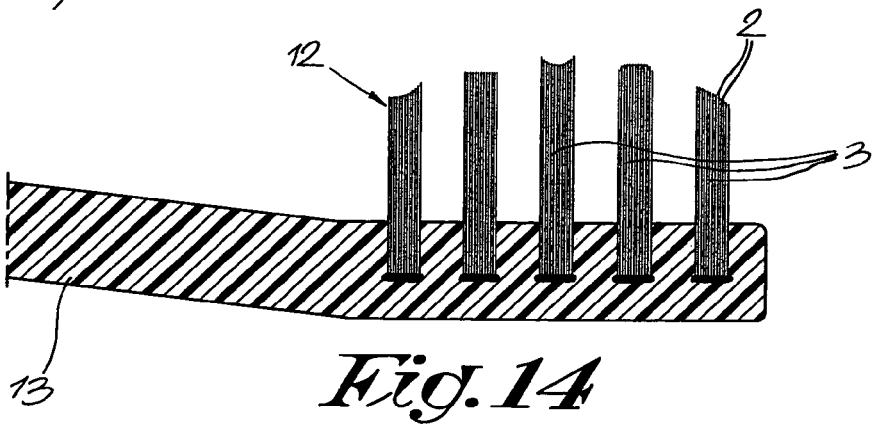
FIG. 14 represents a brush whose fiber bundles have been processed in the device from FIG. 13.

It is clear that the invention can also be realized in combination with bundles 12 having a different design, even in a single holder 4, as will become clear from the example in FIG. 13. FIG. 14 shows a part of a brush body in which the rounded-off fibers 3 according to FIG. 13 have then been provided.

Although, according to FIG. 13, one has to make sure that the far ends 2 of the fibers 3 in the holder 4 are all in line, it is clear that the invention can also be applied when they are not all in line at their top far ends 2.

Figure 15:
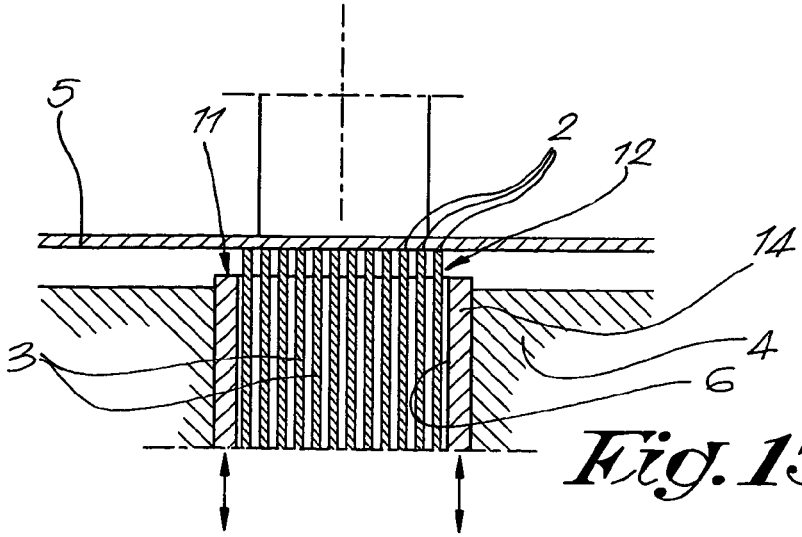
FIG. 15 represents another special embodiment.

FIG. 15 represents another variant, whereby the fibers 3 have been provided in a movable guide 14, which is in turn situated in a holder 4. By moving the guide 14 as indicated, also the movableness of the free ends 2 can be enlarged.

Figure 16:
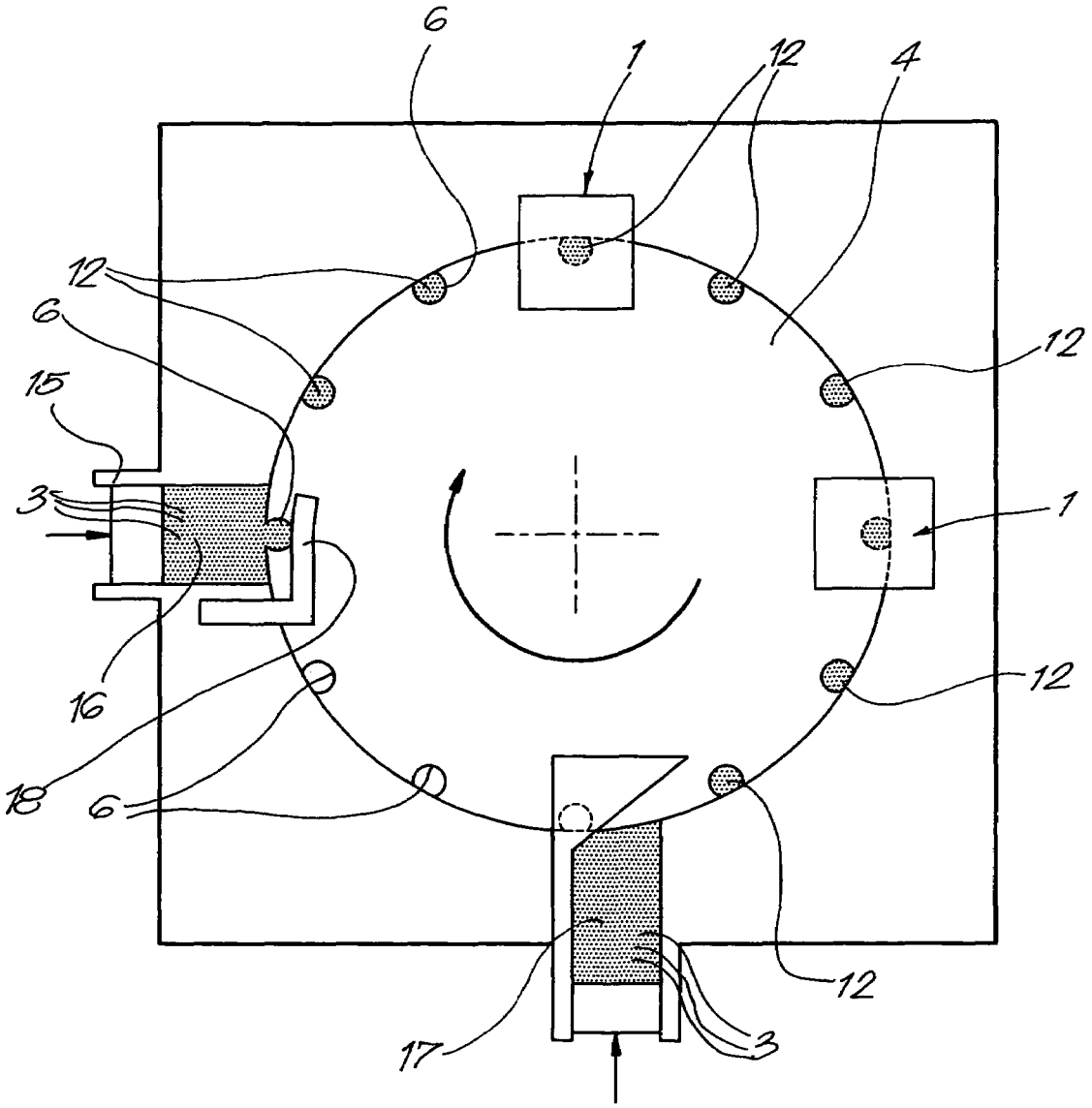
FIG. 16 represents another device according to the invention.

FIG. 16 represents a major application whereby the invention is used in combination with a device of the type whereby bundles of fibers 12 are separated from a fiber stock 16 present in a fiber cartridge 15 by means of a holder 4, in this case a rotating holder 4, and the fibers 3 temporarily remain in this holder 4, to be further processed subsequently, in this case by placing them in a cartridge 17 again, from where they can be further used in any way whatsoever. The holder 4 is hereby embodied as a rotating bundle remover which is provided with one or several take-up openings along its perimeter, also indicated with reference 6, which take-up openings are moved along the fibers 3 of the fiber stock 16.

Along the perimeter are erected one or several devices 1 with which the fibers 3 can be processed in a manner analogous to that in FIGS. 3 to 5.

It should be noted that the take-up openings 6, when aligned with the fiber cartridge 15, may be partly sealed, for example by means of the indicated element 18, as a result of which the fibers 3 end up somewhat loosely in the take-up openings 6 as they move further. This element 18 is optional, however. When the fibers 3 are pushed with little force out of the fiber cartridge 15 into the take-up openings 6, they will still be 'loose' so to say in the take-up openings 6, even if no element 18 is being used.

The present invention is by no means limited to the above-described embodiments given as an example and represented in the accompanying drawings; on the contrary, such a method and device can be made in all sorts of variants while still remaining within the scope of the invention.

The invention claimed is:

1. A method for manufacturing brushes, comprising steps of:

placing a bundle of fibers loosely held in a holder, the fibers having far ends protruded from said holder and subjected to an end grinding process, and free ends opposite said far ends resting loosely on the surface of an underlying support; and bringing said far ends of said fibers into contact with a processing equipment while said fibers are loosely held in said holder; and removing said far ends of said fibers from contact with said processing equipment when said process is complete;

wherein a length of said far ends between said holder and said processing equipment is varied during said end grinding process.

2. The method according to claim 1, wherein the fibers are initially put into contact with the processing equipment with a smaller freedom of movement at the far ends, and that the freedom of movement at the far ends is enlarged afterwards.

3. The method according to claim 2, wherein the processing equipment is initially situated at a first distance from the side of the holder from which the fibers protrude, and in a subsequent step said distance is increased.

4. The method according to claim 3, wherein the first distance is smaller than 1 millimeter.

5. The method according to claim 1, wherein the fibers are placed in an opening in the holder.

6. The method according to claim 1, wherein the distance between the processing equipment and a side of the holder from where the fibers protrude is enlarged, while the contact between the free ends of the fibers and the processing equipment is being maintained.

7. The method according to claim 1, wherein the fibers are initially presented with a length of said far ends which is on average smaller than 1 millimeter.

8. The method according to claim 1, wherein the processing equipment will first be positioned up to a certain distance from the side of the holder out of which the fibers protrude, and the fibers are subsequently brought into contact with the processing equipment with their far ends.

9. The method according to claim 1, wherein, apart from the aforesaid holder and the processing equipment, use is also made of a number of push-out elements, and the variation in the length of the far ends from the holder is obtained by moving one or several of the holder, the processing equipment, and the push-out elements.

10. The method according to claim 1, wherein it is used for rounding off the far ends of the fibers.

11. The method according to claim 1, wherein use is made of a grinding tool as a processing equipment.

12. The method according to claim 1, wherein it is used for manufacturing tooth brushes.

13. The method according to claim 1, wherein it is applied in combination with the use of at least one holder which is provided with at least one opening in which the fibers have been provided by pushing them in the longitudinal direction.

14. The method according to claim 1, wherein it is used in a manufacturing process whereby bundles of fibers are placed in a holder as a function of a fiber bundle pattern of a brush or of a brush part to be manufactured, after which the thus obtained package of bundles of fibers placed in the holder is further processed in order to fix this package of bundles of fibers in a brush body, whereby the above-mentioned processing is then carried out while the bundles are situated in the above-mentioned holder.

15. The method according to claim 1, wherein the method of claim 1 is used in a manufacturing process wherein bundles of fibers are separated from a fiber stock by means of a holder and temporarily remain in said holder to be further processed subsequently, in particular to be further processed in the manufacturing process of the brushes, wherein the above-mentioned processing then takes place while the bundles are situated in the above-mentioned holder.

16. The method according to claim 15, wherein a rotating bundle remover is used as a holder which is provided with one or several take-up openings along its perimeter, and which moves at least along a fiber cartridge, in which the aforesaid fiber stock is present.

17. The method according to claim 16, wherein the take-up openings, when aligned with said fiber cartridge, are only partly filled by fibers from said fiber cartridge.

18. The method according to claim 15, wherein the processed bundles of fibers from the holder are placed in a cartridge again.

* * * * *

UNITED STATES PATENT AND TRADEMARK OFFICE

CERTIFICATE OF CORRECTION

PATENT NO. : 7,641,287 B2
APPLICATION NO. : 10/776166
DATED : January 5, 2010
INVENTOR(S) : Bart Gerard Boucherie It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 517 days.

Signed and Sealed this

Twenty-first Day of December, 2010

David J. Kappos

David J. Kappos
*Director of the United States Patent and Trademark Office*